US007639829B2

(12) United States Patent
Husung

(10) Patent No.: US 7,639,829 B2
(45) Date of Patent: Dec. 29, 2009

(54) LOW-RADIATION ELECTROMAGNETIC EARPIECE

(75) Inventor: Kunibert Husung, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 753 days.

(21) Appl. No.: 11/182,327

(22) Filed: Jul. 15, 2005

(65) Prior Publication Data

US 2006/0013432 A1 Jan. 19, 2006

Related U.S. Application Data

(60) Provisional application No. 60/588,173, filed on Jul. 15, 2004.

(30) Foreign Application Priority Data

Jul. 15, 2004 (DE) ..... 10 2004 034 513

(51) Int. Cl.
*H04R 25/00* (2006.01)

(52) U.S. Cl. ..... 381/324; 381/409; 381/418

(58) Field of Classification Search ..... 381/322, 381/324, 328, 396, 409, 410, 417, 418, 176, 381/189, 400, 401; 174/33, 34, 250, 261
See application file for complete search history.

(56) References Cited

U.S. PATENT DOCUMENTS 3,671,684 A * 6/1972 Tibbetts et al. ..... 381/189
4,410,769 A * 10/1983 Tibbetts ..... 310/25
5,193,116 A * 3/1993 Mostardo ..... 381/324
5,357,051 A * 10/1994 Hwang ..... 174/33
5,459,284 A * 10/1995 Bockelman et al. ..... 174/34
5,814,095 A 9/1998 Müller et al.
6,466,679 B1 10/2002 Husung
2003/0066676 A1 4/2003 Stonikas et al.

FOREIGN PATENT DOCUMENTS

DE 198 54 201 C2 5/2001

OTHER PUBLICATIONS

Jörg, "Lautsprecherbuch", Telekosmos-Verlag, Franckh'sche Verlagshandlung Stuttgart, 1967, p. 37.
"Störsicherer Entwurf von elelcronischen Geräten und Komponenten (EMV)", Gysel, ZHW, Departement Technik, Informatik und Naturwissenschafte Elektrotechnik und Signalverarbeitung, (2002).

* cited by examiner

*Primary Examiner*—Huyen D Le
(74) *Attorney, Agent, or Firm*—Schiff Hardin LLP

(57) ABSTRACT

In an electromagnetic earpiece with a housing in which a coil through which an energizing current flows as well as a membrane are arranged such that the membrane can be excited to vibrate as a result of the energizing current, the parasitic leakage field generated by the electromagnetic earpiece is be reduced. This is accomplished by internally-running connection lines optimally close together between the ends of the coil and the electrical connections of the electromagnetic earpiece so that the leakage field thereby generated is kept optimally low according to the physical principle of a double conductor, producing an advantageous electromagnetic earpiece in a hearing aid device.

3 Claims, 2 Drawing Sheets

LOW-RADIATION ELECTROMAGNETIC EARPIECE

CROSS REFERENCE TO RELATED APPLICATIONS

The present application claims the benefit of U.S. Provisional Application No. 60/588,173, filed Jul. 15, 2004, herein incorporated by reference.

BACKGROUND

The invention concerns an electromagnetic earpiece with a housing, in which a coil through which an energizing current flows as well as a membrane, are arranged such that the membrane can be excited to vibrate as a result of the energizing current, whereby within the housing internal connection conductors are directed from the coil ends to electrical connections on the housing.

In electro-acoustic apparatuses, and particularly in hearing aid devices, electromagnetic earpieces are used to transduce electrical signals into acoustic signals. Due to the required miniaturization of these apparatuses, hearing aid devices have a problem in that electromagnetic leakage fields emanating from the earpiece interfere with other components of the hearing aid devices. In particular, the reception via an induction, telephone, or hearing coil in a hearing aid device can be disturbed by the leakage field generated by an earpiece.

From the prior art, measures are known in order to confine the leakage field emanating from an earpiece. For example, an induction coil is, in principle, arranged in the housing of a hearing device with an optimally large distance from the earpiece. Furthermore, it is known to provide particular shielding plates. These known shielding plates can, however, only influence a portion of the leakage fields. An optimally complete shielding of the earpiece is therewith not possible.

A cone speaker with a voice coil through which an audio-frequency alternating current i flows is known from Jecklin, Jürg, "Lautsprecherbuch", Telekosmosverlag, Franckh'sche Verlagshandlung, Stuttgart, 1967, page 37. The cone speaker comprises a membrane that is arranged such that the membrane can be excited to vibrate. Furthermore, the cone speaker comprises wires that supply the alternating current i to the voice coil. Within the cage, internal connection lines are routed from the coil ends of the voice coil to electrical connections on the cage.

German patent document DE 198 54 201 C2 discloses a hearing aid device with an earpiece for sound emission and with an induction coil for inductive acquisition of signals as well as with a compensation inductor for generating a compensation field, whereby the compensation inductor is positioned in the signal line of the earpiece between the induction coil and the earpiece such that its compensation field is directed counter to the magnetic field of the earpiece given operation of the induction coil, and a coupling between the earpiece and the induction coil is prevented.

SUMMARY

The object of the present invention is to reduce the scatter radiation emanating from an earpiece.

This object is achieved in an electromagnetic earpiece with a housing in which are arranged a coil with energizing current flowing through it as well as a membrane, such that the membrane can be excited to vibrate as a consequence of the energizing current, whereby, within the housing, internal connection lines are directed from the coil ends to electrical connections on the housing, in that the internal connection lines are at least substantially consolidated close together and directed from the coil ends to the electrical connections.

According to embodiments of the invention, the parasitic magnetic fields generated in the earpiece are reduced, in that the physical properties of a "double conductor" (in which both conductors have the same current flowing through them in opposite directions) are used via the close proximity of the connection lines. Previously, the goal was to keep the connection lines in the earpiece as short as possible in order to prevent leakage fields. In embodiments of the invention, larger line lengths are acceptable in that both connection lines are in close proximity over a better part or a majority of their length so that their magnetic fields largely compensate one another. The longer line lengths thus lead to a reduction of the leakage fields.

In an advantageous embodiment of the invention, the connection wires are twisted in the region in which they are routed in close proximity to one another. This has the effect that the distance between the connection lines also does not change given agitation or motion and that the generated leakage field is further reduced. The twisted region may comprise substantially all of a region from a first coil end to one of the electrical connections on the housing.

Electromagnetic earpieces according to embodiments of the invention are best suited for use in hearing aid devices, since there leakage fields very strongly affect adjacent components due to the intended miniaturization of these apparatuses. The quality of hearing aid devices can thus be increased overall and the maximal possible system amplification can be increased in such apparatuses. Low-leakage field earpieces lead to short development times in hearing devices of a higher power class since instabilities in the acoustic coil operation are prevented. Moreover, the wireless RF signal transfer in hearing aid device systems is less interference-prone since radio-frequency emissions of clocked output stages are reduced.

DESCRIPTION OF THE DRAWINGS

The invention is subsequently explained in detail using an exemplary embodiment illustrated in the drawings.

DETAILED DESCRIPTION OF THE PREFERRED EMBODIMENTS

Figure 1:
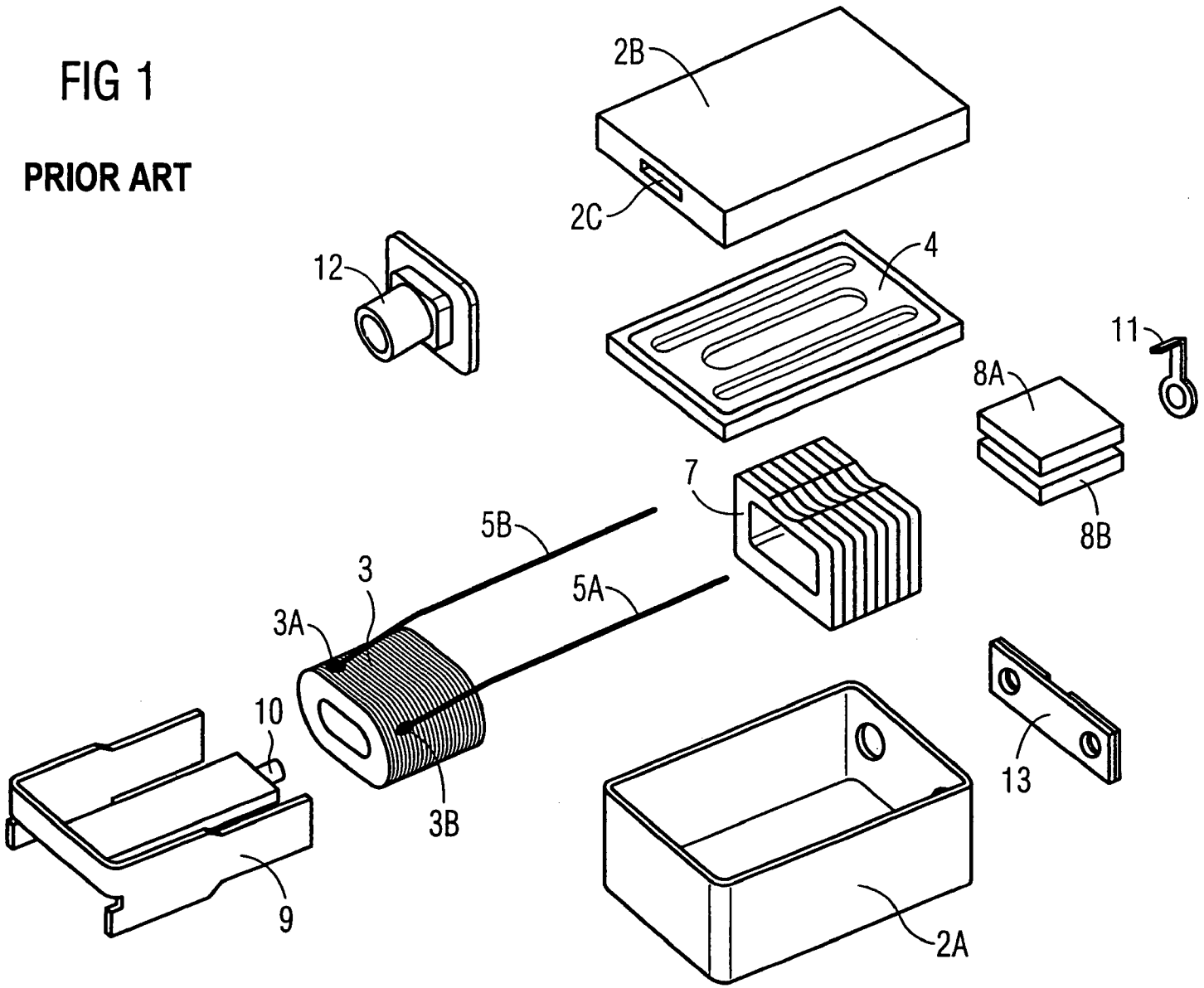
FIG 1 PRIOR ART
FIG. 1 is an exploded perspective view of the components of an electromagnetic earpiece according to the prior art.

FIG. 1 shows the components of an electromagnetic earpiece according to the prior art in an exploded perspective view. The electromagnetic earpiece comprises a housing with a lower housing part 2A and a cover 2B. An energizing winding is located in the housing in the form of a coil 3. The coil 3 is provided at the coil ends 3A and 3B with connection lines 5A and 5B that are routed outwards through the housing in straight lines and have an optimally short length.

To form a magnetic circuit, an iron core 7 is also located in the housing with an air gap, two magnets 8A and 8B as well as a magnetic field refeed 9 that comprises a tongue 10 that, in an assembled state of the earpiece 1, is directed through the coil 3. An energizing current flowing through the coil 3 excites the tongue 10 to vibrate.

The mechanical vibrations are transferred to a membrane 4 via a drive peg 11 that is attached to the end of the tongue 10. The sound thereby generated escapes the earpiece through a slit 2C in the housing cover 2B and a sound exit nozzle 12. A connection plate 13 is provided with electrical contacts, and both connection lines 5A and 5B are soldered with the connection plate 13. The connection plate 13 is located on an external side of the lower housing part 2A for electrical connection of the earpiece.

Figure 2:
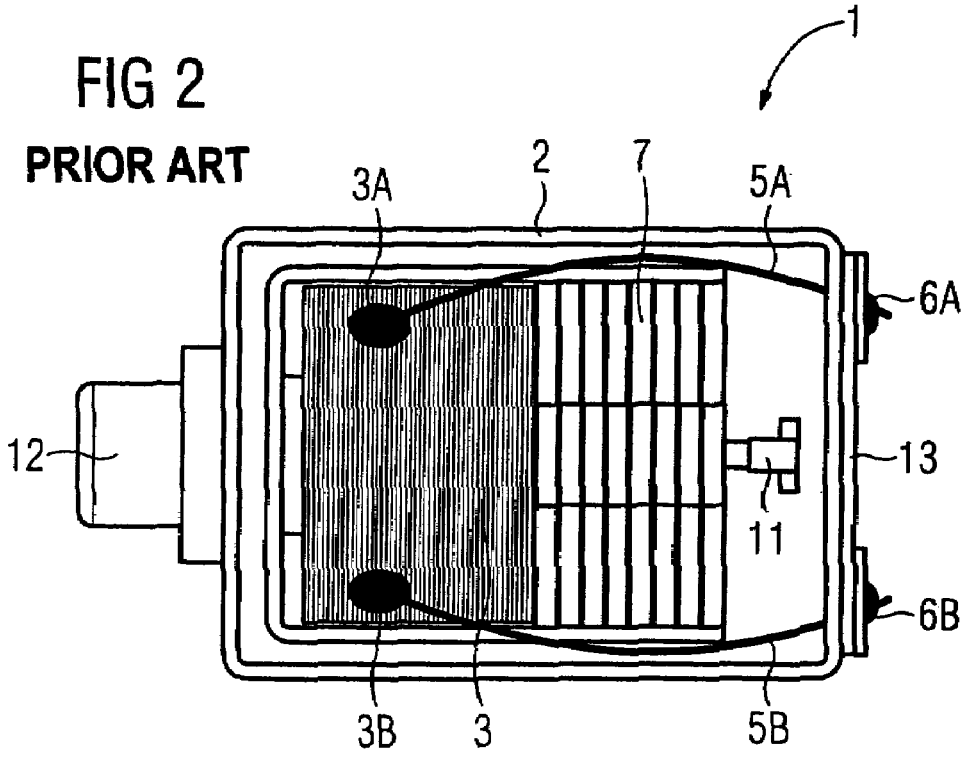
FIG 2 PRIOR ART
FIG. 2 is a cross-section view of an electromagnetic earpiece according to the prior art.

FIG. 2 shows a plan view of the opened earpiece according to the prior art illustrated in FIG. 1. In addition to the housing cover 2B, the membrane 4 is additionally removed. The energizer winding 3, the iron core 7 as well as the drive peg 11 are thereby visible inside the housing 2 of the electromagnetic earpiece 1. The coil 3 is soldered with the connection lines 5A and 5B at the coil ends 3A and 3B. The connection lines 5A and 5B are optimally kept short and are directed past the iron core 7, through the housing 2 to the connection plate 13 with the connections (contacts) 6A and 6B. The connection lines 5A and 5B thereby form a current loop of an area that corresponds to approximately 80% of the earpiece cover surface. Since the earpiece cover 2B does not ideally seal the housing 2, the parasitic magnetic fields generated by the connection lines 5A and 5B are radiated outwards. Although the useful field in the magnetic circuit of the earpiece is stronger by some orders of magnitude, it is conducted unimpeded into the iron core. The air gap thereby barely has an influence since it is fashioned very narrow.

Figure 3:
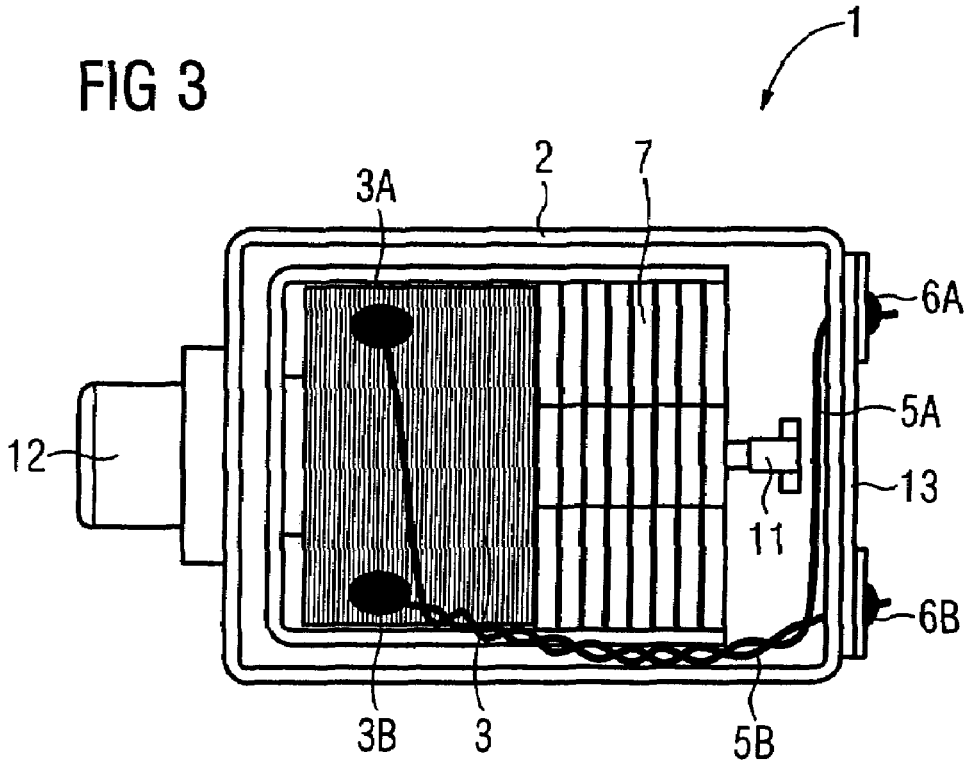
FIG. 3 is a cross-section view of an electromagnetic earpiece according to the invention.

An earpiece 2 modified according to an embodiment of the invention is visible from FIG. 3. In contrast to the earpiece according to FIG. 2, the connection lines 5A and 5B are thereby routed lying optimally close to one another from the coil ends 3A and 3B to the connections 6A and 6B. Although overall a larger line length is thereby utilized, the parasitic leakage field generated by the connection lines 5A and 5B is thereby kept optimally low by the special conductor routing. Namely, the magnetic fields of the two connection lines 5A and 5B largely compensate one another according to the physical principle of the double conductor with current flowing through it in opposite directions.

An embodiment of the invention provides that both connection lines 5A and 5B are twisted with one another in at least a partial region. This ensures that both connection lines 5A and 5B also remain lying close together even given mechanical agitations/motion and the parasitic leakage field generated by the connection lines 5A and 5B is kept optimally small.

Due to the low parasitic leakage field of the earpiece 2, this can be particularly advantageously used in apparatuses in which the earpiece is arranged in immediate proximity to components that are sensitive to disturbances by a parasitic leakage field. This is particularly the case in hearing aid devices in which all essential components lie together in maximally tight space due to the intended miniaturization.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. For the sake of brevity, conventional electronics and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An electromagnetic earpiece, comprising:

a housing comprising electrical connections;

a coil configured to conduct energizing current flowing through it, the coil comprising coil ends;

a membrane configured to oscillate as a result of the energizing current; and internal connection lines that are twisted together at least in sections, and that are routed from the coil ends of the coil to the electrical connections on the housing, with a first of said internal connection lines located at a substantially proximate distance to a second of said internal connection lines for a major portion of either the first of the internal connection lines or the second of the internal connection lines routing from the coil ends to the electrical connections;

the coil, the membrane, and the internal connection lines all being located within the housing.

2. The electromagnetic earpiece according to claim 1, wherein the substantially proximate distance is a distance sufficient to cause the magnetic fields created thereby to largely compensate one another.

3. The electromagnetic earpiece according to claim 1, wherein the sections comprise substantially all of a region from a first coil end to one of the electrical connections on the housing.

* * * * *